US009360157B1

(12) United States Patent
Schwetz et al.

(10) Patent No.: US 9,360,157 B1
(45) Date of Patent: Jun. 7, 2016

(54) BARRIER INSERT FOR TRAFFIC CONES

(71) Applicant: Cone Clip LLC, Sedro Woolley, WA (US)

(72) Inventors: Peter Samuel Schwetz, Sedro Woolley, WA (US); Peter Travis Schwetz, Sedro Woolley, WA (US)

(73) Assignee: ConeClip LLC, Sedro Woolley, WA (US)

( * ) Notice: Subject to any disclaimer, the term of this patent is extended or adjusted under 35 U.S.C. 154(b) by 0 days.

(21) Appl. No.: 14/544,535

(22) Filed: Jan. 16, 2015

Related U.S. Application Data

(60) Provisional application No. 61/965,055, filed on Jan. 17, 2014.

(51) Int. Cl.

| | |
|---|---|
| ***E01F 9/03*** | (2006.01) |
| ***E01F 13/02*** | (2006.01) |
| ***F16M 13/02*** | (2006.01) |
| ***E01F 9/012*** | (2006.01) |

(52) U.S. Cl.
CPC ..... *F16M 13/02* (2013.01); *E01F 9/012* (2013.01); *E01F 9/03* (2013.01); *E01F 13/022* (2013.01); *E01F 13/028* (2013.01)

(58) Field of Classification Search
CPC ..... E01F 9/0122; E01F 9/012; E01F 9/03; E01F 13/028; E01F 13/02; E01F 13/022
USPC ..... 116/63 C, 63 P; D10/113.2; 404/9; 40/607.11
See application file for complete search history.

(56) References Cited

U.S. PATENT DOCUMENTS

| | | | | | |
|---|---|---|---|---|---|
| 2,762,328 | A | | 9/1956 | Weig | |
| 3,132,624 | A | * | 5/1964 | Shoemaker, Jr. | B60Q 7/005 116/63 C |
| 3,380,428 | A | | 4/1968 | Abrams | |
| 4,197,808 | A | * | 4/1980 | Kinninger | E01F 9/011 116/63 C |
| 4,772,869 | A | * | 9/1988 | Grammas | B60Q 7/00 116/63 C |
| 5,195,453 | A | * | 3/1993 | McGibbon, II | E01F 9/0122 116/63 C |
| 5,269,251 | A | * | 12/1993 | Freeman | E01F 9/0122 116/63 C |
| 5,375,554 | A | | 12/1994 | Yen | |
| 5,467,548 | A | * | 11/1995 | Ross | E01F 13/022 116/63 C |
| 6,142,701 | A | | 11/2000 | Falcon | |
| 6,199,504 | B1 | * | 3/2001 | Freeman | E01F 9/0122 116/63 C |
| 6,305,312 | B1 | | 10/2001 | Bent et al. | |
| D452,929 | S | * | 1/2002 | Perelli | D10/109.1 |
| D462,286 | S | * | 9/2002 | Perelli | D10/113.2 |
| 6,448,902 | B1 | | 9/2002 | Tung | |
| 6,536,369 | B1 | | 3/2003 | Bent et al. | |
| 6,769,380 | B1 | | 8/2004 | Carvajalino et al. | |
| 7,056,055 | B1 | | 6/2006 | Kuo | |
| 7,677,533 | B2 | * | 3/2010 | Fracasso | E01F 15/025 256/13.1 |
| D621,289 | S | | 8/2010 | Cortez et al. | |
| 7,997,764 | B1 | * | 8/2011 | Nielson | E01F 9/0122 340/907 |
| D667,747 | S | * | 9/2012 | Klein | D10/121 |

(Continued)

*Primary Examiner* — Ryan Kwiecinski
(74) *Attorney, Agent, or Firm* — Todd N. Hathaway

(57) ABSTRACT

An insert for attaching barricade tape, rope or other flexible line to traffic cones. The insert includes a clip-shaped body having legs that are biased apart to form a jaw area for the tape. The legs are squeezed together by hand and inserted into top openings of the cones. Features on the lower ends of the legs internally engage the upper portion of the cone when released, mounting the insert to the cone with the barricade tape retained in the jaw area.

12 Claims, 5 Drawing Sheets

(56) References Cited

U.S. PATENT DOCUMENTS

| | | | | |
|---|---|---|---|---|
| 8,777,512 | B2 * | 7/2014 | Henderson | E01F 9/0122 116/63 C |
| 8,823,549 | B1 | 9/2014 | Moone | |
| 2005/0008433 | A1 * | 1/2005 | Dvoracek | E01F 9/0122 404/9 |
| 2011/0220010 | A1 * | 9/2011 | Klein | E01F 9/0122 116/63 C |
| 2012/0076970 | A1 * | 3/2012 | Suter | E01F 13/028 428/80 |
| 2012/0186511 | A1 * | 7/2012 | Spray | E01F 9/0122 116/63 C |
| 2013/0333610 | A1 * | 12/2013 | Eccless | E01F 13/028 116/63 C |

* cited by examiner

BARRIER INSERT FOR TRAFFIC CONES

RELATED CASES

The present non-provisional application claims the priority of provisional application Ser. No. 61/965,055 filed Jan. 17, 2014.

BACKGROUND

A. Field of the Invention

The present invention relates generally to barricade devices for control of vehicular and foot traffic, and, more particularly, to an adapter that is detachably insertable in the upper end openings of conventional traffic cones to support warning tape or other barrier material thereon.

B. Related Art

As is well known, temporary barricades are commonly used to control or restrict vehicular and/or foot traffic for a variety of reasons. A well-known example for the use of temporary barricades is to direct vehicles or pedestrians away from a construction area or other job site. Another example is use by law enforcement to exclude unauthorized personnel from crime or accident scenes. As used herein, the terms "barricade" and "barrier" are equivalent in meaning.

A major issue with temporary barricades is portability. By nature such barricades are intended to be erected on a temporary basis, while the construction or other activity is taking place, after which they are removed to allow the vehicles or people to resume their normal course and the components of the barricade are removed and transported to storage or for use at another site. In order to be effective, however, the barricades must generally include some form of horizontal member or members, together with supports that elevate the horizontal member or members a sufficient distance above the ground to form an easily visible "fence" that will not be missed or disregarded by drivers or pedestrians. Use of horizontal members formed of a rigid material, as in the case of traditional wooden "sawhorse" barricades, presents obvious drawbacks in terms of the difficulty and labor involved in transportation and installation/removal. Rope can be used but due to its flexibility must be supported at fairly close intervals to prevent unacceptable sagging, and rope also lacks suitable visibility for many applications. Barricade tape, typically formed of low-stretch polyethylene, is a greatly improved and much more visible alternative to rope and is widely used (for example, as "POLICE" tape); nevertheless it too must be supported and/or held tight at regular intervals to be kept horizontal, and also to prevent excessive fluttering or twisting that would reduce its visibility and also expose it to being caught on vehicles or obstructions.

A wide range of dedicated supports are of course available, however these frequently present transportation, labor and storage issues of their own. Moreover, use of dedicated supports means added inventory and therefore additional purchase and storage costs for the municipality, construction company or other owner. However, such owners typically already have on hand a large number of conventional traffic cones, sometimes referred to as safety cones or construction cones. Traffic cones are typically orange or some other bright color and are commonly molded of synthetic rubber or a somewhat flexible thermoplastic such as vinyl. They are inexpensive, easy to deploy, and nest compactly when stacked so as to take up little room when transported or stored. Most have a frusticonical form with a hole at the top in which a light or sign may be set, and some have a boss that acts as a handle and about which a rope or tape may be tied; with regard to the latter, however, repeatedly tying and untying the numerous knots requires significant time and labor and may also create a safety hazard under some conditions, and in the case of tape the knotting inevitably leads to twisting/crushing of the material so that its visibility is compromised and the material possibly damaged to the point that the tape cannot be reused.

The device shown in U.S. patent publication number 2011/0220010 represents an approach to supporting barrier tape from traffic cones without having to tie or wrap the tape around bosses on the cones. Specifically, the cited application shows a double-ended plug body with a vertical slot that holds the barrier tape. Although clearly a welcome advance over the approach of having to tie the tape around the end of the cone, the device nevertheless possesses certain drawbacks that are significant in the context of practical use in the field. Foremost of these is that the device relies on a push-in engagement with the top opening of the traffic cone: the plastic/rubber material stretches as the conical end of the plug is forced into the opening and then contracts to engage a channel above the conical end to hold the plug against being withdrawn. Although the materials of which traffic cones are constructed are generally flexible, both for safety purposes and to avoid being crushed if driven over, they are not necessarily optimized for resilient expansion/contraction and are therefore subject to wear and distortion if such plugs are repeatedly inserted and retracted, to the point where they may no longer be usable with the device in the referenced application. Moreover, traffic cones by nature lead a hard life and the opening may be distorted or damaged from service to the point where it will not work with a plug-type insert to begin with. Furthermore, while not overly difficult to install, the plug-type insert is difficult to withdraw, a point which is in fact stressed by the referenced application; removal of the plug-type inserts is thus labor-intensive and time consuming at best, and possibly damaging to the openings of the cones, however leaving the inserts in place makes it impossible to use the cones with other types of inserts (e.g., signs or lights) and also makes it difficult or impossible for the cones to nest compactly when stacked. Leaving the plug bodies in place also renders them susceptible to damage, for example, during handling or when run over by a car when serving as a conventional traffic cone on a highway.

SUMMARY OF THE INVENTION

The present invention addresses the problems cited above, and is a resiliently compressible insert for holding an elongate flexible member such as barricade tape and that is detachably mountable in the upper opening of a conventional traffic cone.

In a broad aspect, the insert may comprise: (i) first and second elongate leg portions having lower ends that are resiliently biased apart to form a jaw area that receives portion of the elongate flexible member therein; (ii) first and second outwardly facing engagement portions on lower ends of said leg members; and (iii) grip areas on outer sides of the first and second leg members that permit the leg members to be pressed together between the fingers and palm of a hand so that the elongate flexible member is captured in the jaw area and the engagement portions on the lower ends of the legs are able to pass freely through the opening of the traffic cone, and so that when the grip areas are released the leg portions spread apart resiliently so that the engagement portions internally engage the material of the apex portion of the cone. The engagement portions may comprise outwardly directed jaws that engage a rim of material about the opening of the traffic cone.

The insert may further comprise a connection portion that interconnects the upper ends of the leg portions and from which the leg portions diverge at an angle so as to form a v-shaped jaw area. The grip areas may comprise outer surfaces of the first and second leg members that are sized to fit between the fingers and palm of a hand. The leg members may further comprise inside surfaces that come together in response to the legs being compressed so as to grip the barricade tape or other elongate flexible member in the jaw area.

The engagement portions on the lower ends of the leg members may comprise outwardly directed jaws dimensioned to receive a rim of material about the top opening of a traffic cone. The engagement portions may comprise vertically spaced upper and lower flanges defining channels that form the jaws. The lower flange portions may be sized relatively smaller so that when the first and second leg members are pressed together the lower flanges are able to pass freely through the opening in the traffic cone. The upper flanges may be sized relatively larger so as to react against the perimeter of the opening to arrest further insertion of the engagement portions of the clip into the traffic cone. The flanges of the engagement portions of the first and second leg members may comprise semicircular flanges that extend in substantially diametrically opposite directions from the ends of the leg members, so that when the leg members are compressed together the semicircular flanges come together in a substantially circular form to create an annular engagement about a perimeter of the opening of the cone.

The insert may further comprise a head portion extending above the connection portion joining the leg members. The head portion may comprise an opening for passage of a rope or other cord therethrough. The inser may further comprise a relatively narrower neck portion joining the head portion to the connector portion of the clip, that forms a notch area in which a string or other cord may be wrapped about or tied to the clip.

The clip may be formed unitarily of a resiliently flexible material. The resiliently flexible material may be for example a resiliently flexible thermoplastic material.

These and other features and advantages of the invention will be more fully appreciated from a reading of the following detailed description with reference to the accompanying drawings.

DETAILED DESCRIPTION

Figure 1:
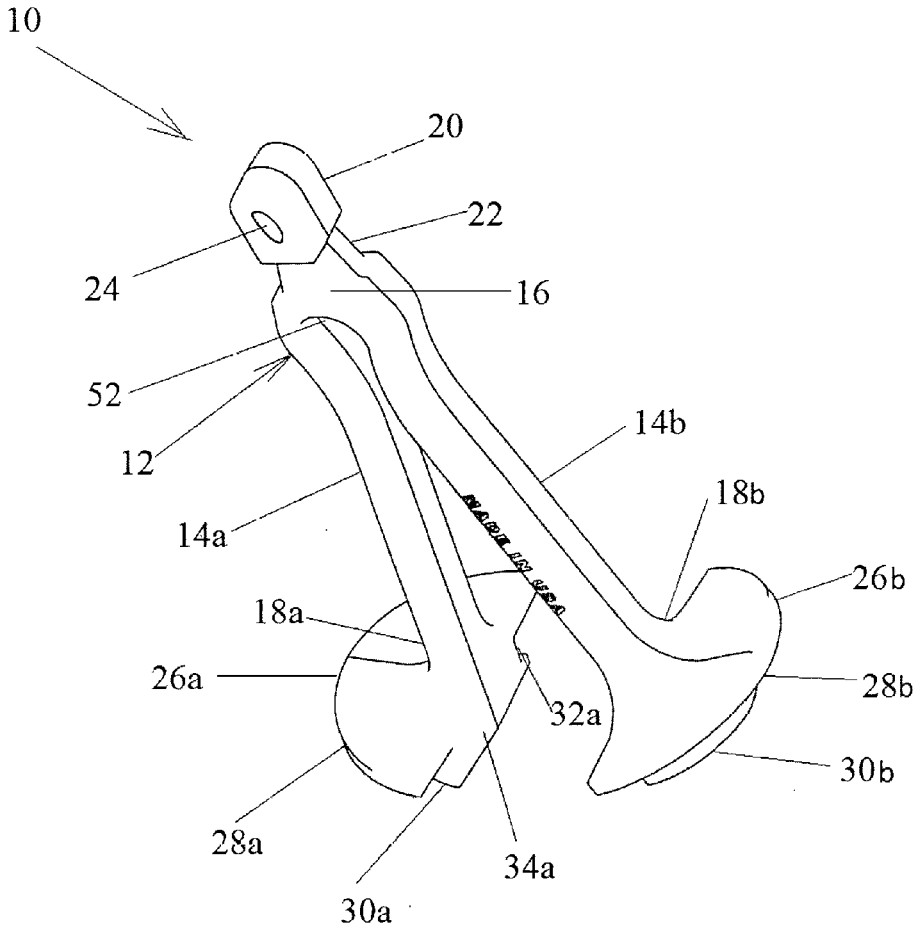
FIG. 1 is a perspective view of a barrier tape attachment inser for traffic cones, in accordance with a preferred embodiment of the present invention.

FIG. 1 shows a barrier tape attachment insert 10 for use with conventional traffic cones having a top opening, in accordance with a preferred embodiment of the present invention.

As can be seen, attachment insert 10 includes a one-piece clip-shaped body 12 molded or otherwise formed of a resiliently flexible material. Suitable resiliently flexible materials include, without limitation, resiliently flexible polymeric materials such as ABS, polypropylene, or molded nylon for example, or resiliently flexible metals or other non-polymeric materials such as bent or stamped steel, for example. The clip is most preferably formed by injection molding of a resiliently flexible plastic material, providing significant advantages in terms of both cost and longevity. It will be understood, however, that some embodiments may employ a multipart construction or may be made of more than one type of material, for example, using a rigid material for the legs and a resiliently flexible material for the joint or hinge at which the legs are connected.

As can be seen with further reference to FIG. 1, the body 12 of the insert includes first and second elongate leg portions 14*a-b* that meet wishbone-fashion at an upper junction portion 16, and that diverge angularly towards their lower end portions 18*a-b*. A head portion 20 is formed on a neck 22 that extends upwardly from the junction portion 16, and includes an opening 24 for passage of a rope/cord or hook therethrough.

First and second engagement portions 26*a-b* are formed at the divergent lower ends 18*a-b* of leg portions 14*a-b*. The engagement portions serve to form the connection with the perimeter of the top opening of the traffic cone, and each includes substantially diametrically opposed semicircular upper and lower flange portions 28*a-b* and 30*a-b* separated vertically by short bosses 32*a-b* to create a gap sized to receive the annular rim of material about the opening of the cone.

Figure 2:
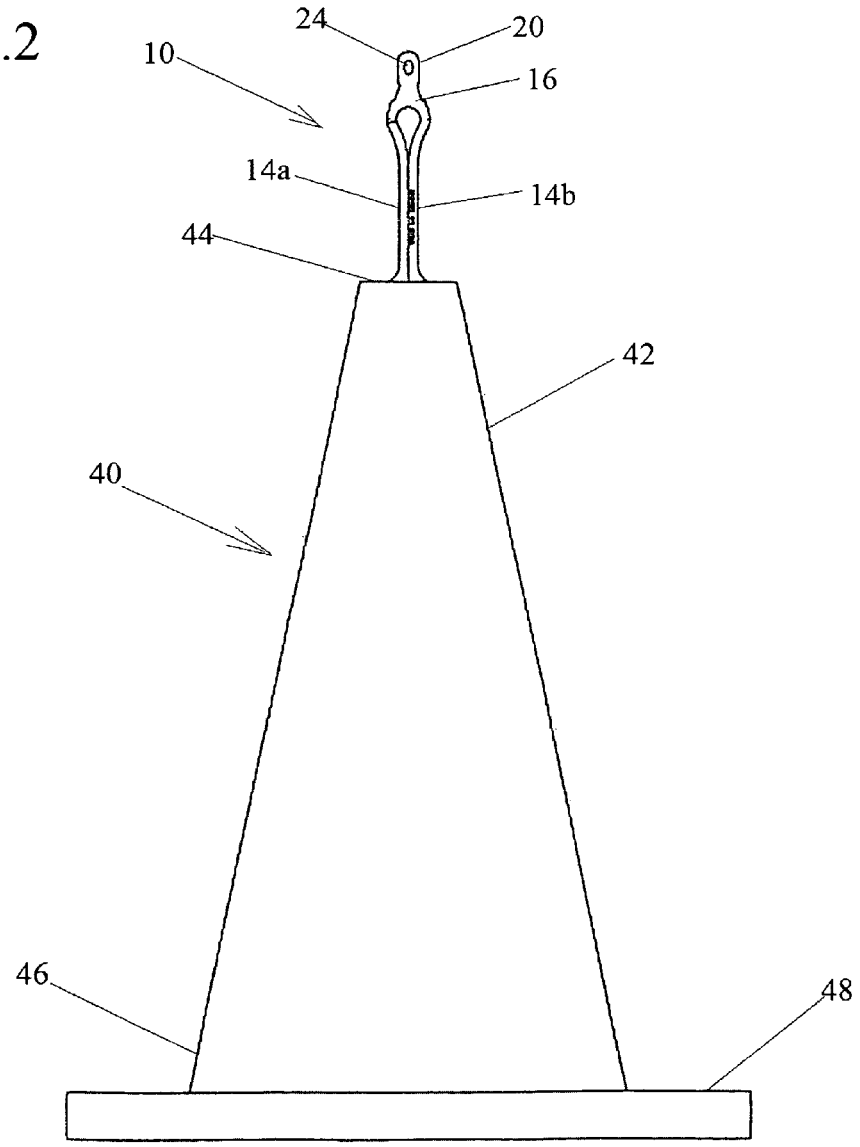
FIG. 2 is an elevational view of the tape attachment insert of FIG. 1 installed in the top opening of an exemplary traffic cone.

FIG. 2 shows clip 10 installed in an exemplary traffic cone 40. The traffic cone illustrated is of a typical type, many variations of the same basic configuration being available on the market.

As can be seen, the cone 40 has a generally frusticonical form, with an upper end 42 tapering in the apex area towards a flattened, generally horizontal top surface 44 in which the opening (not shown) is formed. The material of the cone forms an inwardly projecting annular flange about the circumference of the top opening, that is engaged between the flange portions of the clip as will be described in greater detail below. The cone tapers outwardly towards its lower end 46, to which a generally horizontally extending base plate 48 is typically mounted. As noted above, the interior of the traffic cone is hollow to permit the cones to nest compactly when stacked.

To install the insert 10 the user places the barrier tape (not shown) in the jaw area between the leg portions 14*a-b*, holding the clip in one hand and the tape in the other, and then squeezes the clip closed to hold the tape in place. With the clip closed the flat inner sides 34*a-b* of the engagement portions at the lower ends of the clip come together, reducing the effective diameter defined by the lower semi-circular flange portions 30*a-b* sufficiently that the latter will pass freely through the opening with little or no force. The larger diameter upper flange portions 28*a-b* in turn come into contact the upper surface 44 of the cone, arresting further insertion of the clip and acting to stabilize it against lateral forces. The user then releases the clip from the hand so that the leg portions 14*a-b* spread apart resiliently until the engagement portions 26*a-b* contact the edges of the opening in the cone, the annular rim of the opening being captured within the semi-circular channels 36*a-b* formed by the bosses 32*a-b* between the upper and lower flange portions 28*a-b* and 30*a-b*. In the event that the opening is ovalled out or otherwise distorted or damaged, the resiliency of the legs allows them to expand outwardly so as to nevertheless form an engagement with the rim of the opening.

It will be appreciated that the barricade tape is held flat between the parallel inside surfaces of the legs 14*a-b* when the latter are squeezed closed, avoiding any twisting/binding or damage to the material of the tape. As an alternative or in addition to the barricade tape, a rope or cord may be strung between the cones, through the openings 24 in the heads of the clips.

For removal/recovery, the upwardly protruding clip 10 can be used as a handle if desired, grasping the clip with moderate pressure and lifting the cone and tape together. At the desired point the legs of the clip can be squeezed together by applying additional grip pressure to release the clip from the cone, for example to drop the latter onto a stack of other cones for transportation/storage. The grip can then be relaxed so as to allow the legs to spread apart, releasing the tape for re-use if desired, after which the clip can be dropped into a box or other container for storage of its own. In so doing, all components are conveniently and efficiently stored, and moreover the end opening of the traffic cones retain their integrity for re-use over numerous cycles. All of this can be achieved in a very rapid, efficient and convenient manner, even from a truck or other moving vehicle if desired.

Having provided an overview, the structure of the clip will now be described in greater detail with reference to FIGS. 3-5.

Figure 3:
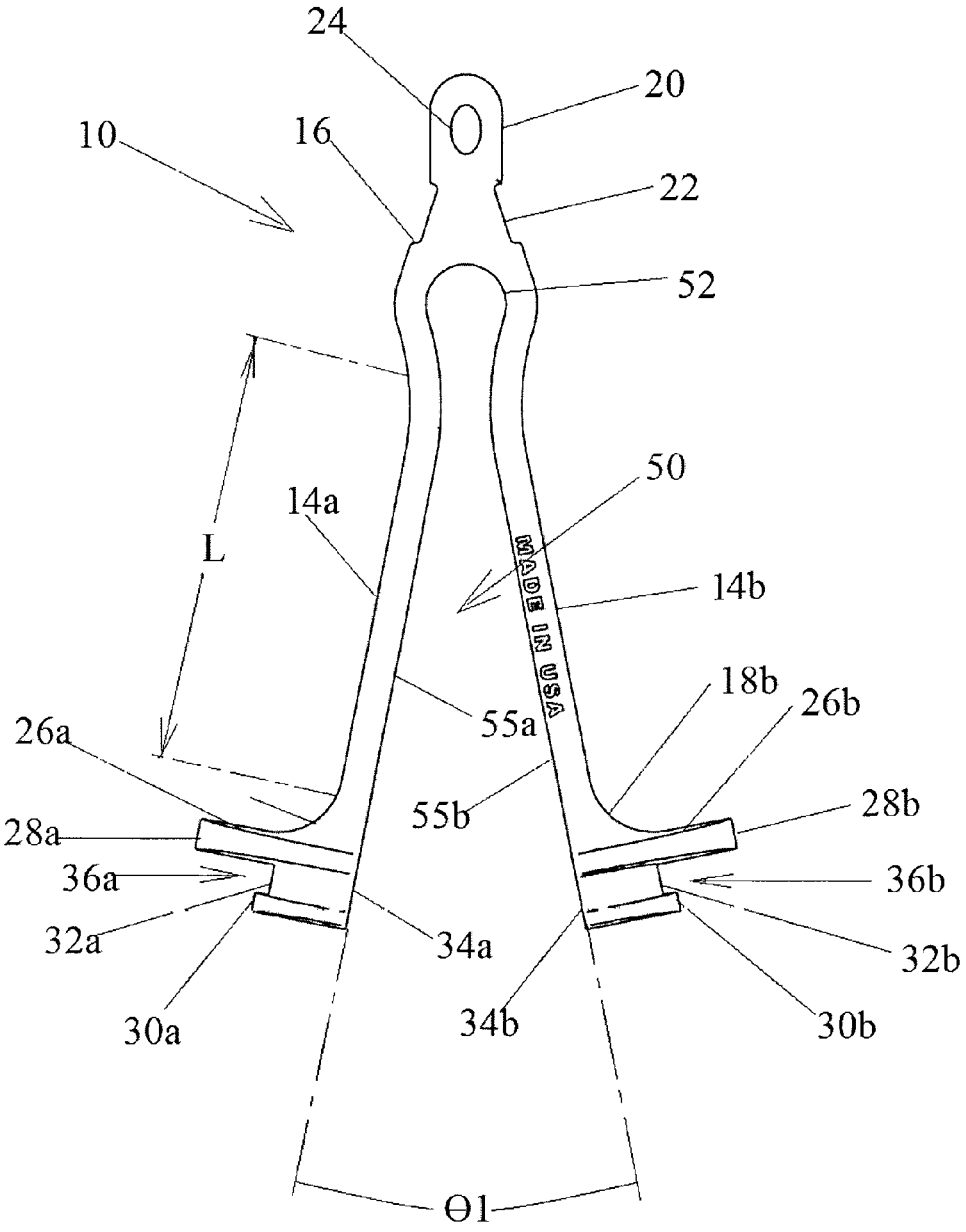
FIG. 3 is a front elevational view of the tape attachment insert of FIG. 1, showing the structure and also the relationship of the resiliently compressible legs thereof in greater detail.
Figure 4:
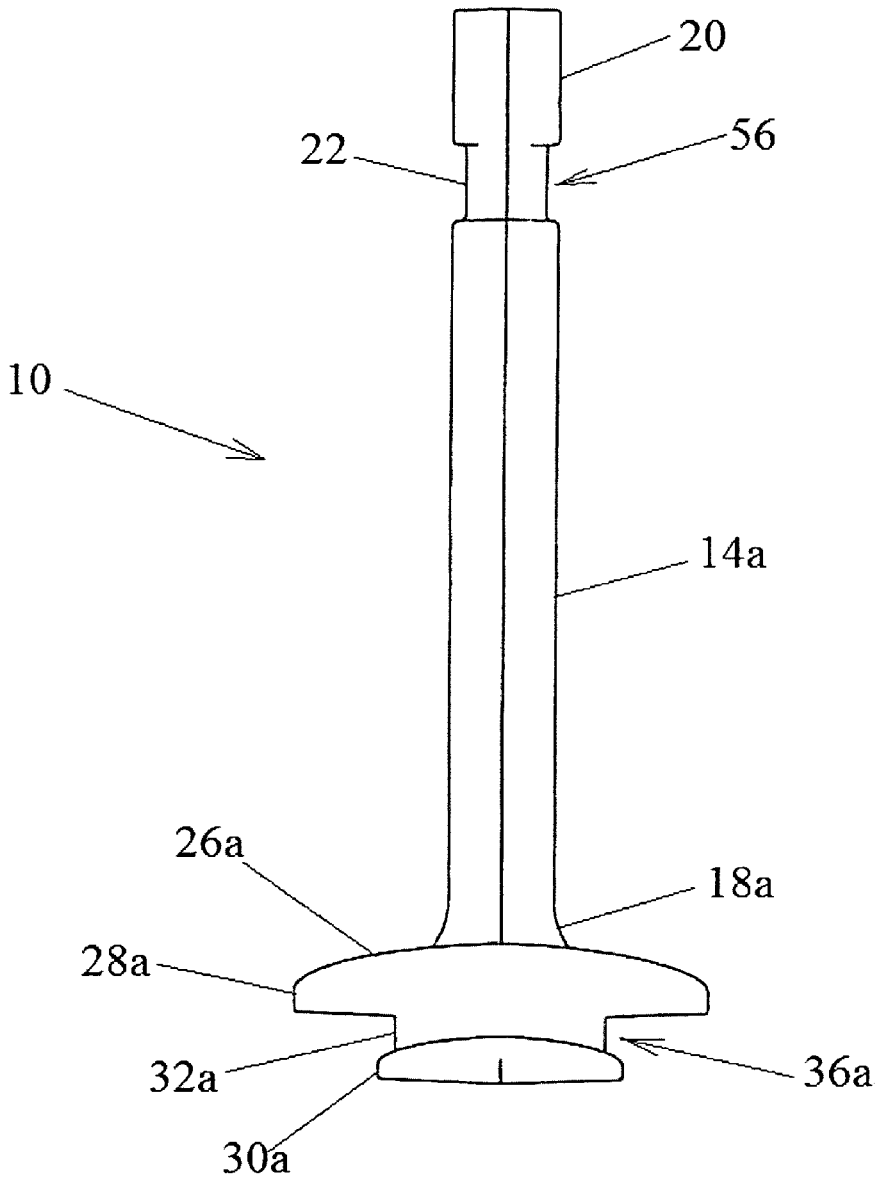
FIG. 4 is a side elevational view of the tape attachment insert of FIG. 3, showing the configuration of the engagement flanges on the ends of the resilient legs in greater detail.

As can be seen in FIG. 3, when the clip 10 is in its initial, released configuration, the lower end portions 18*a-b* are spread apart so that the generally planar inside surfaces 14*a-b* of the legs diverge by an angle $\Theta_1$ so as to define a jaw-shaped opening 50. At the upper ends of the leg portions a somewhat circular relief 52 is formed, beneath junction 16 so as to allow the legs to flex sufficiently for their inside surfaces to come together to grip the tape. The angle $\Theta_1$ is preferably such that the tape can be inserted quickly without catching on the legs and then the jaw opening closed with an easy squeezing motion of the hand, with an angle of about 10-45 degrees having been found preferable and an angle of about 15 degrees being most preferred. It will be understood, however, that the angle of the jaw opening may vary greatly, depending on the resistance of the material, the thickness of the leg portions, and other design factors.

The outside surfaces 54*a-b* of the legs in turn extend generally parallel to the inside surfaces 55*a-b*, and have a length "1" sized to be gripped between the fingers and palm of a hand. Suitably, the length "1" is in the range of about 2½-4 inches or slightly more, although again it will be understood that this may vary depending on design factors. Moreover, the outside surfaces 54*a-b* may be provided with indentations, texturing or other features to aid in establishing a grip.

As can also be seen in FIGS. 3-4, the neck 22 below head portion 20 is reduced in both side-to-side and front-to-back dimensions so as to define a notch area 56. The notch area 56 serves to permit a string or rope to be tied or wrapped around the neck of the clip, should that be desired for a particular use.

Figure 5:
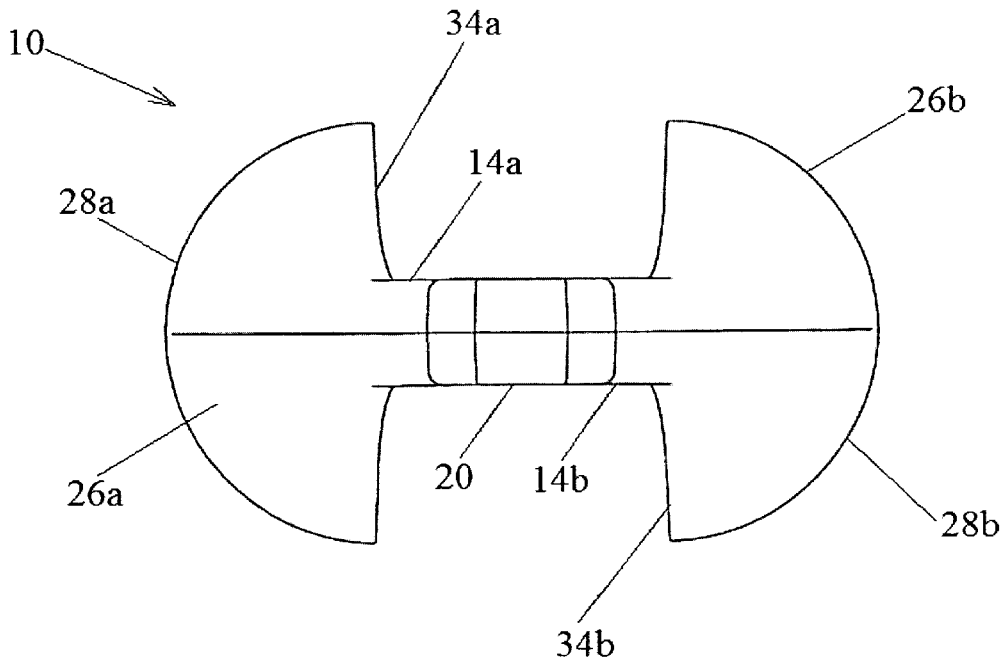
FIG. 5 is a top plan view of the tape attachment inser of FIG. 3, showing in greater detail the relationship of the outwardly facing flanges on the ends of the resilient arms that engage the edges of the opening at the top of the traffic cone.

FIG. 5 shows more clearly the diametrically opposed relationship of the semi-circular engagement portions 26*a-b* at the lower ends of legs 14*a-b*, that meet when the legs are squeezed together so that the upper and lower flanges form substantially complete circles. The flanges consequently create an engagement with the material of the cone about substantially the entire the rim of the opening so as to stabilize the clip in all directions. As can also be seen in FIG. 5, slight angled reliefs are formed on the inner sides 34*a-b* of the engagement portions so as to prevent the outer edges of the latter from coming into contact before the inside surfaces of the legs have been pressed together against the tape.

The clip of the preferred embodiment as shown in the drawings and described above is directed towards holding warning tape to form a barrier. It will be understood, however, that in some embodiments the clip may be configured to hold other materials forming a horizontal barrier, such as rope or other flexible or rigid materials.

It is to be recognized that various alterations, modifications, and/or additions may be introduced into the construction and arrangement of parts described above without departing from the spirit or ambit of the present invention as defined by the appended claims.

What is claimed is:

1. A barrier insert for mounting an elongate member to an apex portion of a traffic cone, said barrier insert comprising:

first and second elongate leg portions having lower ends that are resiliently biased apart to form a jaw area dimensioned to receive a portion of said elongate member therein;

first and second outwardly facing engagement portions on said lower ends of said first and second elongate leg portions, said engagement portions on said lower ends of said first and second elongate leg portions comprising:

outwardly directed jaws dimensioned to receive material of said traffic cone about a rim of an opening in said apex area of said cone, said outwardly directed jaws of said engagement portions on said lower ends of said first and second elongate leg portions comprising upper and lower flange portions that are vertically spaced to define channels that form said outwardly directed jaws of said engagement portions; and grip areas on outer sides of said first and second elongate leg portions that permit said first and second elongate leg portions to be pressed together by a hand of a user so that said first and second outwardly facing engagement portions on said lower ends of said first and second elongate leg portions come together to freely enter said opening in said apex portion of said traffic cone;

said jaw area being configured to capture said elongate member in response to said first and second elongate leg portions being pressed together so that said engagement portions come together to enter said opening in said apex portion of said traffic cone, and said engagement portions being configured to internally engage said opening in said apex portion of said traffic cone in response to said first and second elongate leg portions being released to spread apart so as to mount said insert to said apex portion of said traffic cone with said elongate member retained in said jaw area of said insert.

2. The barrier insert of claim 1, further comprising:

a resilient junction portion that joins upper ends of said first and second elongate leg portions and from which said leg members extend to form said jaw opening.

3. The barrier insert of claim 2, wherein said barrier insert further comprises:

a head portion that extends above said junction portion that joins said upper ends of said first and second elongate leg portions.

4. The barrier insert of claim 3, wherein said head portion of said barrier member comprises:

at least one opening for passage of an elongate cord therethrough.

5. The barrier insert of claim 4, further comprising:

a narrowed neck portion joining said head portion to said junction portion of the barrier insert, said neck portion forming a notch area that receives a cord wrapped around or tied to said barrier insert.

6. The barrier insert of claim 1, wherein said first and second elongate leg portions comprise:

outer surfaces that are dimensioned to be gripped between the fingers and palm of a user's hand.

7. The barrier insert of claim 6, wherein said first and second elongate leg portions further comprise:

inner surfaces that extend in parallel juxtaposition when said first and second elongate leg portions are pressed together, so as to hold said elongate member generally upright from said apex portion of said traffic cone.

8. The barrier insert of claim 1, wherein said lower flange portions are sized relatively smaller so that when said first and second elongate leg portions are pressed together said lower flange portions are able to pass freely through said opening in said apex portion of said traffic cone, and said upper flange portions are sized relatively larger so that when said first and second elongate leg portions are pressed together said upper flange portions react against a perimeter of said opening to arrest insertion of said engagement portions beyond said rim of said opening.

9. The barrier insert of claim 8, wherein said upper and lower flanges of said engagement portions on said first and second elongate leg portions comprise:

generally semicircular flanges that extend in diametrically opposite directions from said lower ends of said first and second elongate leg portions, so that when said first and second elongate leg portions are pressed together said semicircular flanges come together in a substantially circular form to create a generally annular engagement with said rim about said opening in said apex portion of said traffic cone.

10. The barrier insert of claim 1, wherein said barrier insert is formed unitarily of a resilient material.

11. The barrier insert of claim 10, wherein said resilient material of which said clip is formed unitarily is a resiliently flexible thermoplastic material.

12. A barrier insert for mounting an elongate member to an apex portion of a traffic cone, said barrier insert comprising:

first and second elongate leg portions having lower ends that are resiliently biased apart;

first and second outwardly facing engagement portions on said lower ends of said first and second elongate leg portions, said engagement portions on said lower ends of said first and second elongate leg portions comprising:

outwardly directed jaws dimensioned to receive material of said traffic cone about a rim of an opening in said apex area of said traffic cone, said outwardly directed jaws of said engagement portions on said lower ends of said first and second elongate leg portions comprising upper and lower flange portions that are vertically spaced to define channels that form said outwardly facing jaws of said engagement portions; and grip areas on outer sides of said first and second elongate leg portions that permit said first and second elongate leg portions to be pressed together by a hand of a user so that said first and second outwardly facing engagement portions on said lower ends of said first and second elongate leg portions come together to freely enter said opening in said apex portion of said cone;

said engagement portions being configured to internally engage said opening in said apex portion of said traffic cone in response to said first and second elongate leg portions being released to spread apart so as to mount said insert to said apex portion of said traffic cone.

* * * * *